US010278549B1

(12) United States Patent
Carignan et al.

(10) Patent No.: US 10,278,549 B1
(45) Date of Patent: May 7, 2019

(54) COUNTER-MOUNTED SKINCARE PRODUCT DISPENSER

(71) Applicant: GPCP IP Holdings LLC, Atlanta, GA (US)

(72) Inventors: Ryan David Carignan, Oshkosh, WI (US); Douglas E. Seals, Fitchburg, WI (US); Jacob Charles Dahl, Menasha, WI (US); Darryl Tyler Rathbun, Atlanta, GA (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 15/338,902

(22) Filed: Oct. 31, 2016

(51) Int. Cl.

| | |
|---|---|
| ***A47K 5/12*** | (2006.01) |
| ***A47K 5/14*** | (2006.01) |
| ***B05B 11/00*** | (2006.01) |
| ***B05B 12/12*** | (2006.01) |
| ***B05B 15/62*** | (2018.01) |

(52) U.S. Cl.
CPC ..... *A47K 5/1211* (2013.01); *A47K 5/1217* (2013.01); *A47K 5/14* (2013.01); *B05B 11/0054* (2013.01); *B05B 11/0097* (2013.01); *B05B 12/122* (2013.01); *B05B 15/62* (2018.02); *A47K 2005/1218* (2013.01)

(58) Field of Classification Search
CPC ..... A47K 5/1211; A47K 5/14; A47K 5/1217; A47K 2005/1218; B05B 15/061; B05B 12/122; B05B 11/0054; B05B 11/0097; B05B 15/62
See application file for complete search history.

(56) References Cited

U.S. PATENT DOCUMENTS

| | | | | |
|---|---|---|---|---|
| 5,410,867 | A | 5/1995 | Plamper et al. | |
| 5,632,414 | A | 5/1997 | Merriweather, Jr. | |
| 5,781,942 | A | 7/1998 | Allen et al. | |
| 5,791,525 | A * | 8/1998 | Fan | A47K 5/1204 222/181.3 |
| 5,802,948 | A | 9/1998 | Andrisin, III et al. | |
| 5,829,636 | A | 11/1998 | Vuong et al. | |
| 5,875,555 | A | 3/1999 | Andrisin, III et al. | |
| 5,944,227 | A | 8/1999 | Schroeder et al. | |
| 5,988,451 | A | 11/1999 | Hanna | |
| 6,016,936 | A * | 1/2000 | Fan | A47K 5/1204 222/181.1 |
| 6,082,586 | A * | 7/2000 | Banks | A47K 5/14 222/95 |

(Continued)

FOREIGN PATENT DOCUMENTS

WO WO 2015/085195 A1 6/2015

*Primary Examiner* — Donnell A Long
(74) *Attorney, Agent, or Firm* — Alston & Bird LLP

(57) ABSTRACT

A counter-mounted dispenser for dispensing a skincare product includes an above-counter spout and a below-counter drive housing for engaging a replaceable refill unit. The refill unit includes a reservoir configured for holding a volume of skincare fluid, a pump assembly for pumping skincare fluid from the reservoir, and a dispensing tube for delivering the pumped skincare fluid. The reservoir defines a central axis and includes a handle positioned on an outer perimeter of the reservoir. A pump assembly is mounted on the reservoir in a position that is offset from the center of the reservoir in a direction opposite the reservoir's handle.

12 Claims, 9 Drawing Sheets

(56) References Cited

U.S. PATENT DOCUMENTS 6,085,509 A 7/2000 Plamper et al.
D429,694 S 8/2000 Schlessinger et al.
6,119,901 A 9/2000 Hanna
D431,394 S 10/2000 Ciavarella et al.
6,129,245 A 10/2000 Redman et al.
6,142,342 A 11/2000 Lewis
6,321,943 B1 * 11/2001 Strickler ..... A47K 5/1204 222/156
6,467,651 B1 10/2002 Muderlak et al.
6,581,804 B1 6/2003 Ciavarella et al.
D479,422 S 9/2003 Ciavarella et al.
6,619,512 B1 9/2003 Sayers et al.
D480,247 S 10/2003 Ciavarella et al.
D480,639 S 10/2003 Ciavarella et al.
6,651,851 B2 11/2003 Muderlak et al.
6,691,893 B2 2/2004 Gauthier
6,701,573 B1 3/2004 Ciavarella et al.
6,910,604 B2 6/2005 Gugliotti et al.
D507,831 S 7/2005 Rosenkranz et al.
6,929,150 B2 8/2005 Muderlak et al.
7,011,237 B1 3/2006 Sayers et al.
7,025,227 B2 4/2006 Oliver et al.
7,032,782 B1 4/2006 Ciavarella et al.
7,044,328 B1 5/2006 Ciavarella
7,066,357 B2 6/2006 Ciavarella et al.
7,086,567 B1 8/2006 Ciavarella et al.
D552,906 S 10/2007 Zlatic et al.
7,290,546 B2 11/2007 Sprinkle et al.
7,364,053 B2 4/2008 Ophardt
7,431,182 B2 10/2008 Ciavarella
7,455,197 B2 11/2008 Ophardt
D583,931 S 12/2008 Rosenkranz et al.
7,503,465 B2 3/2009 Ciavarella et al.
7,527,174 B2 5/2009 Meehan et al.
7,533,787 B2 5/2009 Muderlak et al.
7,543,722 B2 6/2009 Yates et al.
7,611,317 B2 11/2009 Muderlak et al.
7,621,274 B2 11/2009 Sprinkle et al.
7,621,426 B2 11/2009 Reynolds et al.
7,637,391 B2 12/2009 Rosenkranz et al.
7,681,765 B2 3/2010 Muderlak
D616,684 S 6/2010 Ciavarella et al.
D617,129 S 6/2010 Ciavarella et al.
7,753,087 B2 7/2010 Rhodenbaugh et al.
7,798,370 B2 9/2010 Ciavarella et al.
7,806,301 B1 10/2010 Ciavarella et al.
7,815,074 B2 10/2010 Ciavarella et al.
7,837,066 B2 11/2010 Reynolds et al.
7,850,049 B2 12/2010 Ciavarella et al.
7,874,463 B2 1/2011 Ciavarella
D631,681 S 2/2011 Ciavarella et al.
7,950,548 B2 5/2011 Ciavarella et al.
D640,125 S 6/2011 Rosenkranz et al.
7,984,831 B2 7/2011 Kanfer et al.
8,020,731 B2 9/2011 McCullough et al.
8,047,403 B2 11/2011 Quinlan et al.
8,047,404 B2 11/2011 Quinlan et al.
8,065,758 B1 11/2011 Mendez
8,087,545 B2 1/2012 Ciavarella et al.
8,091,738 B2 1/2012 Ciavarella
8,100,299 B2 1/2012 Phelps et al.
D653,482 S 2/2012 Ciavarella et al.
8,113,389 B2 2/2012 Lewis et al.
8,235,689 B2 8/2012 Ciavarella et al.
8,276,784 B2 10/2012 Ciavarella et al.
8,296,875 B2 10/2012 Loberger et al.
8,313,008 B2 11/2012 Ciavarella et al.
8,313,010 B2 11/2012 Quinlan et al.
8,348,101 B2 1/2013 Ciavarella et al.
8,360,287 B2 1/2013 Ciavarella et al.
8,365,963 B2 2/2013 McCullough et al.
8,371,474 B2 2/2013 Tramontina et al.
8,479,951 B2 7/2013 Ciavarella et al.
8,480,967 B2 7/2013 Zlatic et al.
8,485,395 B2 7/2013 Ciavarella et al.
8,499,981 B2 8/2013 Quinlan et al.
8,534,504 B2 9/2013 Archer
8,544,698 B2 10/2013 Ciavarella et al.
8,556,121 B2 10/2013 Reynolds et al.
8,561,847 B2 10/2013 Rosenkranz et al.
8,579,157 B2 11/2013 Bem et al.
8,579,159 B2 11/2013 Ciavarella
8,590,751 B2 11/2013 Ciavarella et al.
8,616,414 B2 12/2013 Ciavarella
8,662,355 B2 3/2014 Spiegelberg et al.
8,668,116 B2 3/2014 Ciavarella et al.
8,668,118 B2 3/2014 Tsai et al.
8,740,019 B1 6/2014 Ciavarella et al.
8,763,863 B2 7/2014 Quinlan et al.
8,770,440 B2 7/2014 Lin
8,777,062 B2 7/2014 Ciavarella
8,783,510 B2 7/2014 Reynolds et al.
8,800,815 B1 8/2014 Butler et al.
8,827,119 B2 9/2014 Ciavarella et al.
8,844,769 B2 9/2014 Rosenkranz et al.
8,851,335 B2 10/2014 Ciavarella et al.
8,875,952 B2 11/2014 Ciavarella et al.
8,893,928 B2 11/2014 Proper
8,925,766 B2 1/2015 Gray et al.
8,944,288 B2 2/2015 Ciavarella et al.
8,950,019 B2 2/2015 Loberger et al.
8,950,628 B2 2/2015 Muderlak et al.
8,950,632 B2 2/2015 Ciavarella et al.
8,955,718 B2 2/2015 Ciavarella et al.
8,955,769 B2 2/2015 Pelfrey et al.
8,991,657 B2 3/2015 Ciavarella et al.
9,027,790 B2 5/2015 Ciavarella et al.
9,038,682 B2 5/2015 Wang
9,038,862 B2 5/2015 McNulty et al.
9,072,412 B2 7/2015 Ciavarella et al.
9,089,244 B2 7/2015 Gray et al.
9,089,860 B2 7/2015 Quinlan et al.
9,096,995 B1 8/2015 Al-Qaneei
9,101,952 B2 8/2015 McNulty et al.
9,144,351 B2 9/2015 Ciavarella et al.
9,155,428 B2 10/2015 Haworth
9,271,613 B2 3/2016 Rosko et al.
9,380,916 B2 * 7/2016 Allef ..... A47K 5/14
9,854,947 B2 * 1/2018 McNulty ..... A47K 5/14
2010/0147879 A1 * 6/2010 Ophardt ..... A47K 5/1217 222/52
2010/0314413 A1 12/2010 Jones et al.
2011/0132930 A1 6/2011 Haworth
2013/0020351 A1 1/2013 Pelfrey
2013/0032614 A1 2/2013 Babikian et al.
2013/0075420 A1 3/2013 Tramontina et al.
2013/0105519 A1 * 5/2013 Sundberg ..... A47K 5/14 222/153.13
2013/0264355 A1 10/2013 Jodoin
2013/0291947 A1 11/2013 Chandler et al.
2014/0053332 A1 2/2014 Cole
2014/0054320 A1 * 2/2014 Harris ..... A47K 5/14 222/153.09
2014/0124540 A1 5/2014 Ciavarella et al.
2014/0231450 A1 8/2014 Rosko et al.
2014/0259382 A1 9/2014 Dobizl et al.
2014/0263421 A1 9/2014 Urban et al.
2014/0263892 A1 9/2014 Metcalfe et al.
2015/0034680 A1 2/2015 Babikian et al.
2015/0052678 A1 2/2015 Bayley et al.
2015/0090737 A1 4/2015 Ciavarella et al.
2015/0101121 A1 4/2015 Burgo, Sr. et al.
2015/0102067 A1 4/2015 Ciavarella et al.
2015/0157754 A1 6/2015 Rutter et al.
2015/0223645 A1 * 8/2015 Ray ..... A47K 5/1211 222/156
2015/0223646 A1 8/2015 Wegelin et al.
2017/0202411 A1 * 7/2017 Bouton ..... A47K 11/10

* cited by examiner

COUNTER-MOUNTED SKINCARE PRODUCT DISPENSER

BACKGROUND OF THE INVENTION

Field of the Invention

Various embodiments of the present invention described herein generally relate to skincare dispensers. In particular, counter-mounted skincare dispensers having easily replaceable under-counter refill units are described herein.

Description of Related Art

Skincare dispensers are often provided in bathrooms, on work sites, and in other locations for dispensing skincare products, such as liquid or foam soap and anti-bacterial gel. In many environments, counter-mounted skincare dispensers have become increasingly popular. Dispensers of this type may include a pump and a skincare product reservoir positioned below a counter, with an above-counter spout having a touchless sensor designed to activate the pump to dispense the skincare product from the spout. By locating the pump and reservoir below the counter, the space above the counter is kept uncluttered.

As these skincare dispensers are used, the volume of skincare product remaining in the reservoir decreases and must be periodically refilled or replaced. For counter-mounted skincare dispensers, the skincare reservoir is often incorporated as part of a replaceable refill unit, in which a dispensing tube, pump assembly, and reservoir (e.g., a bottle containing fluid soap) are assembled together as one component configured for engagement with a below-counter housing (e.g., a housing in communication with the above-counter spout and having a powered drive system for actuating the refill unit's pump assembly). When the refill unit's reservoir is empty, the entire refill unit is removed from the below-counter housing, discarded, and replaced with a new refill unit having a full reservoir. By using replaceable refill units, the need to manually refill a reservoir at the dispenser's installed location is avoided and the dispenser components incorporated into the replaced refill unit, such as the pump assembly and dispensing tube, are kept clean and in proper working order.

While counter-mounted skincare dispensers with replaceable refill units present various advantages, replacing the refill unit is often difficult and inconvenient for those servicing the dispenser. In particular, the position of the housing underneath the counter can obscure and obstruct access to the refill unit and housing, making it difficult and inconvenient to replace the refill unit.

As one example, U.S. Pat. No. 6,467,651 describes a counter-mounted fluid dispensing apparatus that includes a replaceable module having a reservoir container, a pump mechanism, and a dispensing tube. The dispensing tube and pump assembly are centrally mounted on the top of the reservoir container, such that the reservoir container, the pump mechanism, and the dispensing tube are all aligned on a common centerline. The module is configured to be installed in a housing positioned under a counter, but must be inserted upwardly into the housing and subsequently rotated about the module's central axis to secure the module to the housing. This requires a user to reach a significant distance under the counter to reach the housing and a significant distance downwardly to position the module beneath the housing. In addition, securing the module after upward insertion into the housing requires significant manipulation of the module beneath the counter. As a result, replacing a module of this type is difficult and inconvenient for those servicing the dispenser.

As another example, U.S. Pat. No. 8,544,698 describes a counter-mounted dispenser including a product container, a pump mechanism, and a dispensing tube spaced apart from the pump mechanism. To install the product container, the product container must be inserted upwardly into a bottle support with its pump mechanism aligned with a shaft that activates the pump mechanism. Again, a user must reach a significant distance under the counter to reach the bottle support and a significant distance downwardly to position the container beneath the bottle support. In addition, securing the container after upward insertion into the housing requires significant manipulation of the container beneath the counter to achieve the necessary alignment. As a result, replacing a container of this type is also difficult and inconvenient for those servicing the dispenser.

Accordingly, there is a need in the art for a counter-mounted skincare dispenser having an under-counter refill unit that can be more easily accessed and replaced.

BRIEF SUMMARY

In one embodiment, a skincare dispenser configured for being mounted in a counter includes a refill unit including a reservoir configured for holding a volume of skincare fluid and defining a reservoir central axis. The reservoir includes a handle positioned on an outer perimeter of the reservoir and an upper opening defining an upper opening central axis that is offset from the reservoir central axis in a direction opposite the handle. The refill unit also includes a pump assembly configured for drawing skincare fluid out of the reservoir and mounted on the reservoir's upper opening in alignment with the upper opening central axis. A dispensing tube extends upwardly from the pump assembly and is configured for delivering skincare fluid pumped from the reservoir. The dispenser also includes a drive housing configured for being mounted beneath the counter and defining a cavity shaped to receive the refill unit's pump assembly in order to secure the refill unit to the drive housing. The cavity defines a cavity opening configured to accommodate insertion of the pump assembly into the cavity in a substantially horizontal direction. The dispenser also includes a spout extending upwardly from an upper surface of the counter. The spout defines a central passageway configured for receiving the dispensing tube when the refill unit is secured to the drive housing.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF VARIOUS EMBODIMENTS

Figure 1:
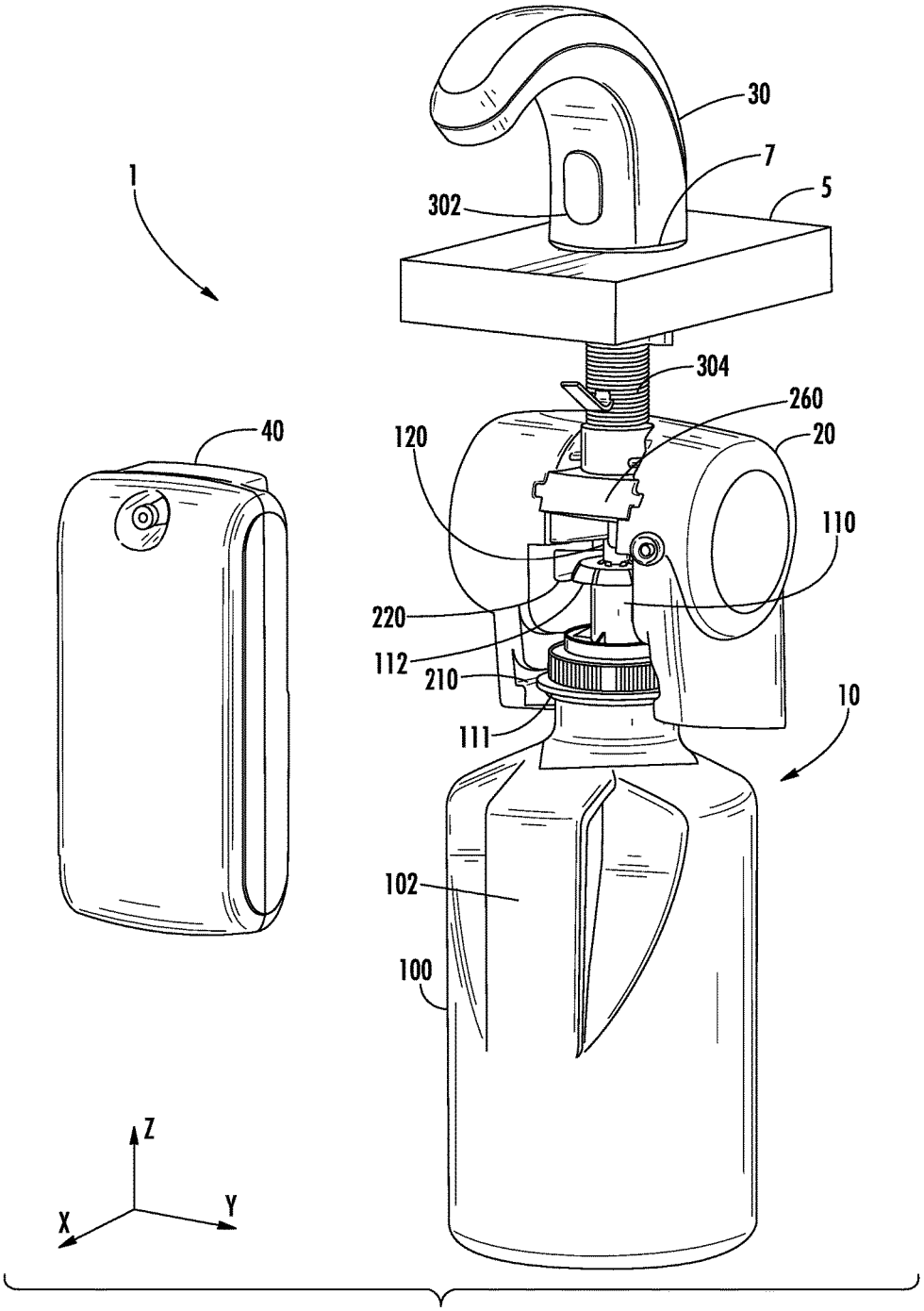
FIG. 1 shows a perspective view of a counter-mounted soap dispenser including a refill unit according to one embodiment.

Various embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout. In addition, the vertical direction (i.e., the +/−Z-direction as depicted in the drawings) refers to the upward/downward direction of the dispenser. Horizontal directions are generally indicated by the X-Y plane. In particular, the longitudinal direction (i.e., the +/−X-direction as depicted in the drawings) refers to the forward/rearward direction of the dispenser and is transverse to the vertical direction. The lateral direction (i.e., the +/−Y-direction as depicted in the drawings) refers to the cross-wise direction of the dispenser and is transverse to the vertical direction and the longitudinal direction.

According to various embodiments, a counter-mounted skincare dispenser is provided for dispensing a skincare product to a user (e.g., foam soap, liquid soap, hand sanitizer, or the like). Various embodiments of the dispenser generally include a spout extending upwardly from a countertop, a drive housing mounted below the countertop and in communication with the spout, and a replaceable refill unit configured for being inserted into the drive housing. The refill unit includes a reservoir for storing a volume of skincare fluid (e.g., liquid soap, anti-bacterial gel, or the like) and a pump assembly for pumping the skincare fluid out of the reservoir and through a connected dispensing tube. When the refill unit is inserted into the drive housing, the dispensing tube can be guided upwardly through the counter and spout and the drive housing can actuate the refill unit's pump assembly in order to dispense the skincare product from the spout to a user. When the refill unit runs out of skincare fluid, the refill unit can be discarded and replaced with a new refill unit having a full supply of skincare fluid.

To keep the upper surface of the counter uncluttered, the drive housing and refill unit are mounted underneath the counter. The drive housing is generally vertically aligned with the spout in order to facilitate insertion of the refill unit's dispensing tube through the drive housing, counter, and spout. The drive housing is also typically positioned a significant distance away from the counter's outer edge due to the conventional location of the spout (e.g., in a bathroom environment, the spout is conventionally positioned proximate a far edge of a sink basin and away from the edge of the counter). As a result, the refill unit—which is engaged with the drive housing during operation of the dispenser—is also positioned under the counter and a significant distance from the counter's edge.

To enable the refill unit to be more easily accessed and replaced, the drive housing is provided with an opening that permits the refill unit to be inserted horizontally into the drive housing. Among other things, this serves to reduce the vertical distance beneath the counter the refill unit must be positioned in order to be engaged with the drive housing. In addition, the refill unit is configured such that its pump assembly is engaged within the drive housing's opening with the refill unit's reservoir suspended below. With respect to a central axis of the refill unit's reservoir, the pump assembly is offset in a direction opposite and away from the refill unit's handle. This configuration effectively extends the user's reach when the user grasps the refill unit's handle in order to horizontally insert the pump assembly into the drive housing. As a result, the horizontal distance from the counter's edge the user must reach in order to engage the refill unit with the drive housing is also reduced. These features improve the ease and convenience of replacing the refill unit, reduce the ergonomic burden on the user, and reduce the time and effort required to replace the refill unit.

As one example, FIG. 1 shows an automated, counter-mounted foam soap dispenser 1 according to one embodiment (herein "dispenser 1"). The dispenser 1 includes a refill unit 10, a drive housing 20, a spout 30, and a power unit 40. As shown in FIG. 1, the spout 30 extends upwardly from a countertop 5 (e.g., a bathroom countertop where the spout 30 is positioned proximate a sink basin) and includes a touchless sensor 302 (e.g., an optical sensor). By contrast, the refill unit 10, drive housing 20, and power unit 40 are mounted below the countertop 5. Although only a portion of the countertop 5 is shown in FIG. 1, it should be understood that the countertop 5 would generally obscure view of the refill unit 10, drive housing 20, and power unit 40 from vantage points above the countertop's upper surface.

Figure 2:
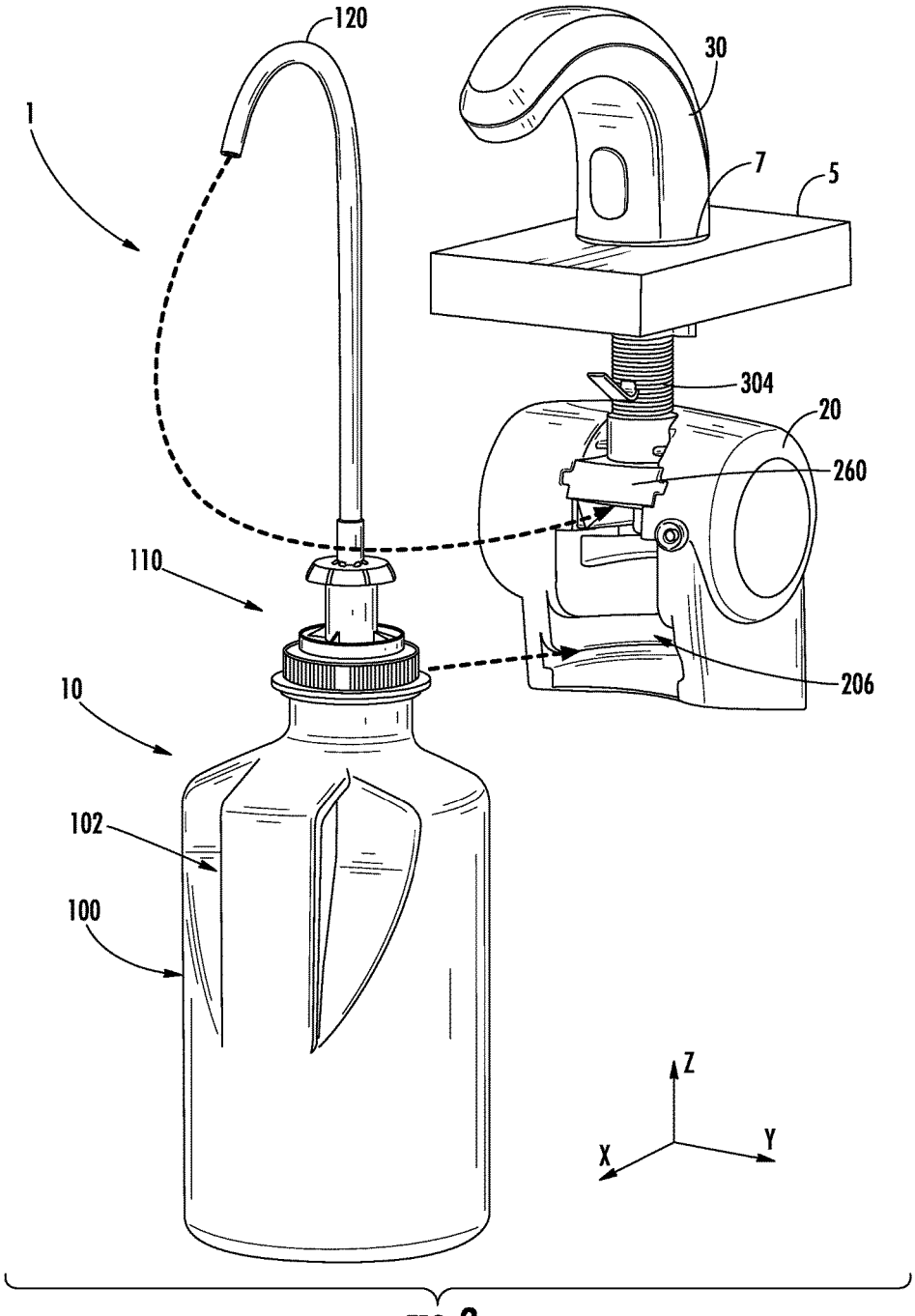
FIG. 2 shows the counter-mounted soap dispenser of FIG. 1 and depicts the insertion of the dispenser's refill unit into the dispenser's drive housing according to one embodiment.

As shown in FIG. 2, the refill unit 10 is configured to be selectively engaged and removed from the drive housing 20 beneath the countertop 5. As explained in greater detail herein, the drive housing 20 is configured to actuate the refill unit 10 in order to create and pump foam soap upwardly through the countertop 5 and out of the spout 30. When the refill unit 10 run out of liquid soap, the refill unit 10 can be removed from the drive housing 20 and replaced with a new refill unit.

Figure 3:
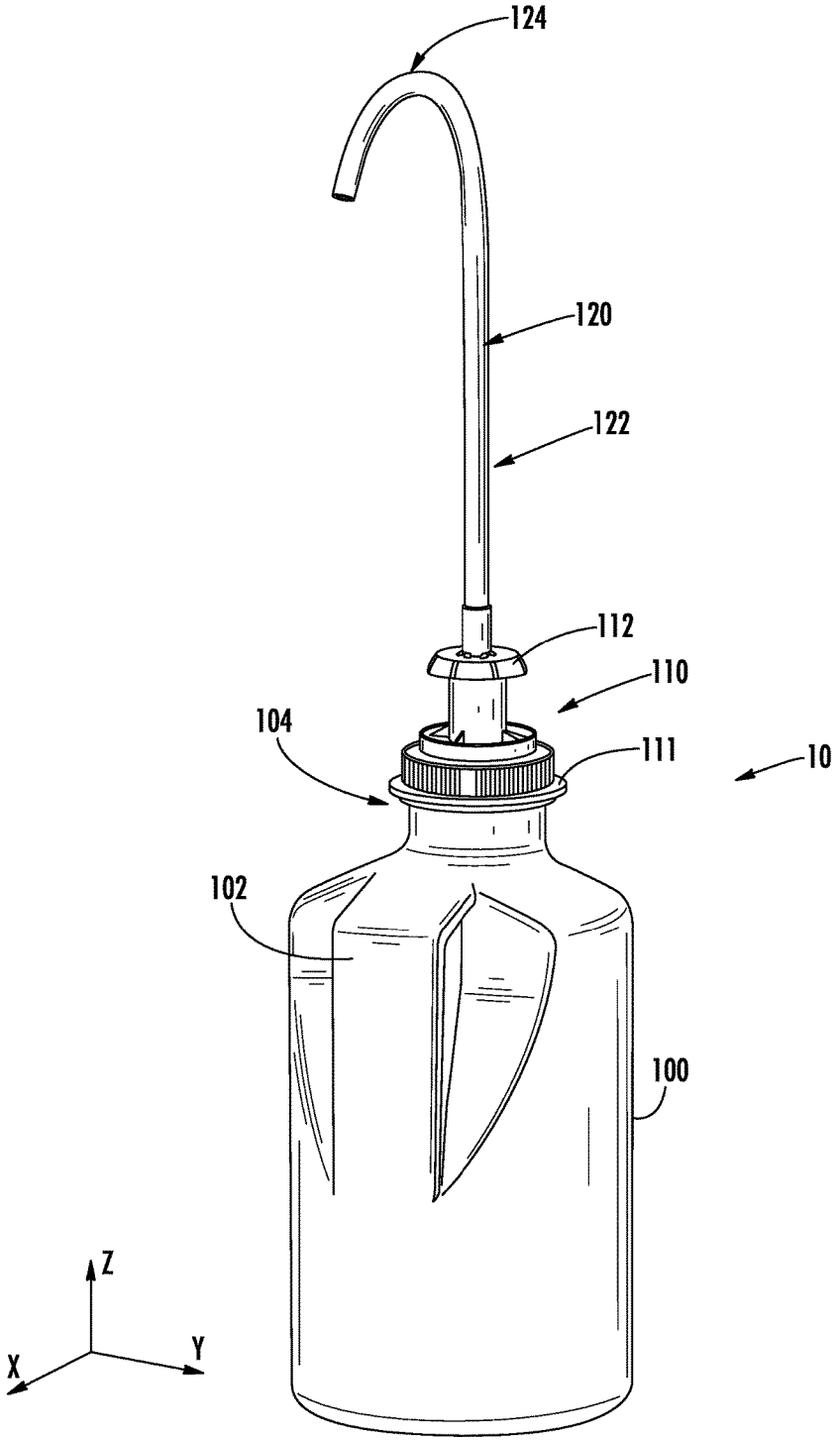
FIG. 3 shows a perspective view of the refill unit of FIG. 1 according to one embodiment.

FIG. 3 shows the refill unit 10 in isolation. In the illustrated embodiment, the refill unit 10 includes a reservoir bottle 100 (herein "reservoir 100"), a pump assembly 110, and a dispensing tube 120. The reservoir 100, pump assembly 110, and dispensing tube 120 are in fluid communication with one another and cooperate to move fluid from the reservoir 100 upward through the dispensing tube 120. In particular, the reservoir 100, pump assembly 110, and dispensing tube 120—when assembled—form an integrated refill unit 10 for use with the dispenser 1 and do not need to be disassembled during normal operation.

As shown in FIG. 3, the refill unit's pump assembly 110 is mounted on an upper portion of the reservoir 100, while the dispending tube 120 extends upwardly from an upper portion of the pump assembly 110. In the illustrated embodiment, the pump assembly 110 includes a perimeter flange 111 that extends radially outward from the pump assembly 110. The perimeter flange 111 engages an upper opening of the reservoir 100 and secures the pump assembly 110 to the reservoir 100. Additionally, as discussed in greater detail herein, the perimeter flange 111 is configured to engage a portion of the drive housing 20 in order to support the refill unit 10 in the drive housing 20. Although not shown, the pump assembly 110 also includes a dip tube that extends downwardly from a lower portion of the pump assembly 110 into the reservoir 100 (e.g., extending substantially to the bottom of the reservoir 100's internal volume). As discussed in more detail herein, the dip tube enables the pump assembly 110 to draw liquid soap from the reservoir 100 and pump it upwardly to the spout 30.

The pump assembly 110 also includes an actuator 112, which is configured for vertical movement relative to the dispensing tube 120 and reservoir 100. Vertical movement of the actuator 112 actuates the pump assembly 110 to pump liquid soap out of the reservoir 100. For example, an upward, expansion stroke of the actuator 112 draws a volume of liquid soap out of the reservoir 100 and a volume of ambient air from outside the pump assembly 110 into one or more pump chambers. A subsequent downward, compression stroke of the actuator 112 then forces the volume of liquid soap and air upwardly through an internal foaming cartridge (where the liquid soap and air mix to form foamed soap). The foamed soap is then forced further upwardly through the dispensing tube 120 and, eventually, out of the spout 30.

The dispensing tube 120 extends upwardly from an upper portion of the pump assembly 110. While the dispensing tube 120 is a flexible member (e.g., a flexible plastic tube), it is shown in FIG. 3 in the shape it would have when inserted through the drive housing 20 and the spout 30 (see e.g., FIG. 1). As a result, the dispensing tube 120 in FIG. 3 comprises a lower portion 122 that is oriented in the vertical direction and is secured to an upper portion the pump assembly 110. The dispensing tube 120 also includes an upper portion 124 that is substantially curved and extends above the lower portion 122. In the illustrated embodiment, the actuator 112 is configured to move around the dispensing tube 120 such that the dispensing tube 120 remains stationary as the pump assembly 110 is actuated (i.e., as the actuator 112 moves vertically the dispensing tube 120 remains stationary).

Figure 4:
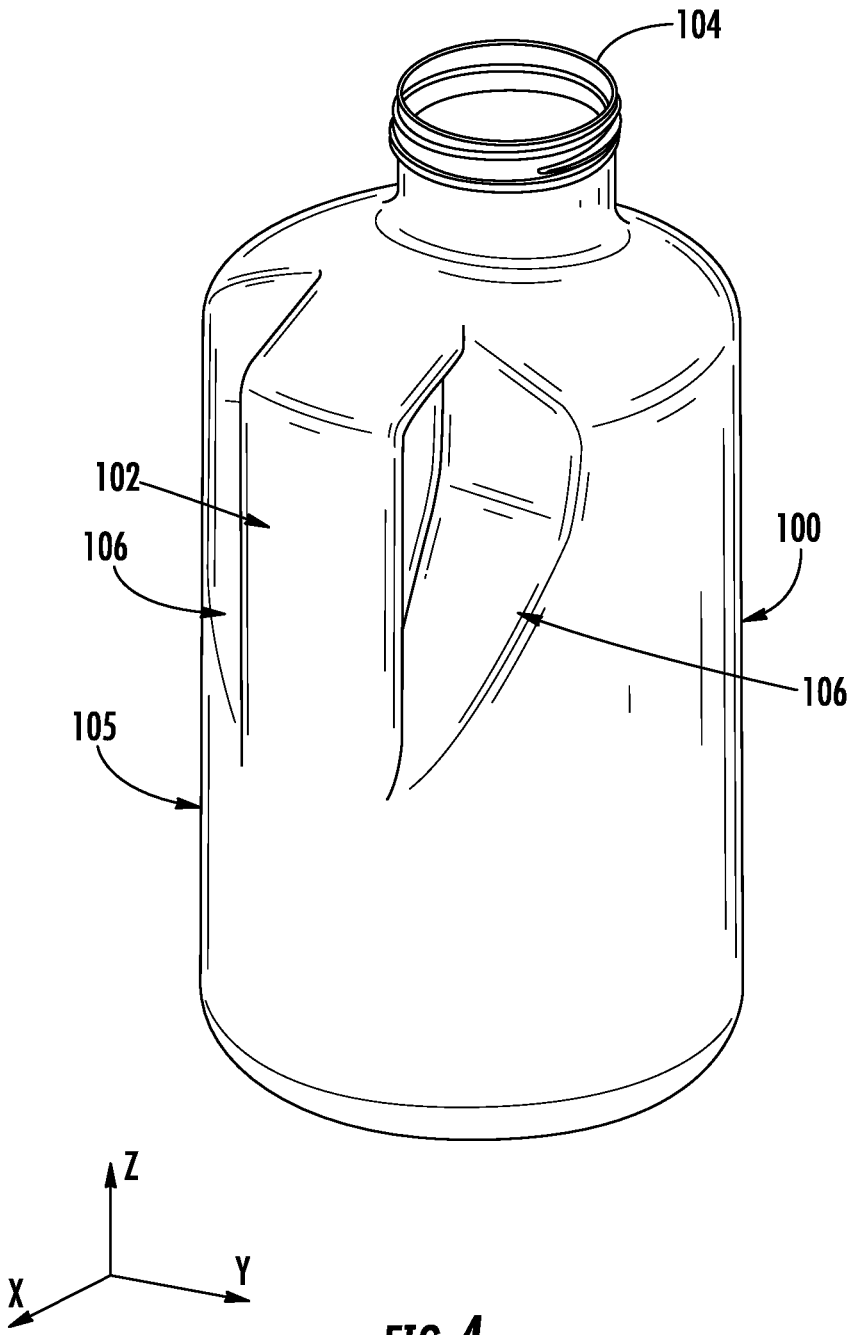
FIG. 4 shows a perspective view of a reservoir of the refill unit of FIG. 3 according to one embodiment.

FIG. 4 shows the reservoir 100 of the refill unit 10 in isolation. In the illustrated embodiment of FIG. 4, the reservoir 100 is cylindrically-shaped bottle having a substantially circular cross-section (i.e., in the X-Y plane). The reservoir 100 defines a circular upper opening 104 positioned at the top of the reservoir 100. The reservoir 100 also defines an integrally formed handle 102 positioned on an outer perimeter 105 of the reservoir 100. In the illustrated embodiment, the handle 102 is formed by a pair of indentations 106 that extend inward from the outer perimeter 105, such that the handle 102 is circumscribed within the outer perimeter 105 of the reservoir 100 (also shown in FIG. 5). In various other embodiments, however, the handle 102 may extend outwardly from the outer perimeter 105 of the reservoir and may be directly or indirectly coupled to the reservoir 100.

Figure 5:
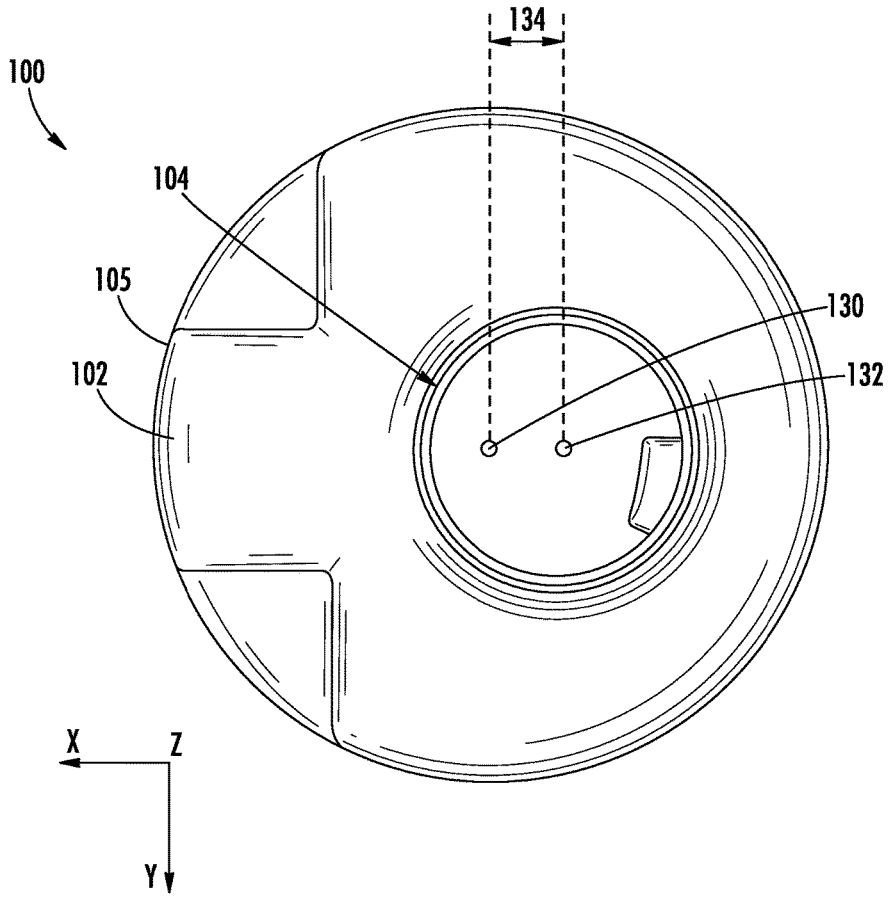
FIG. 5 shows an overhead view of the reservoir of FIG. 4 according to one embodiment.

FIG. 5 shows an overhead view of the reservoir 100. As shown in FIG. 5, the reservoir 100's body defines a reservoir central axis 130 extending vertically (i.e., along the z-axis in FIG. 5) through the geometric center of the reservoir. By contrast, the reservoir's upper opening 104 defines an upper opening central axis 132 that is offset from the reservoir central axis 130. As shown in FIG. 5, the upper opening central axis 132 extends vertically through the geometric center of the upper opening 104. The upper opening central axis 132 is spaced apart from the reservoir central axis 130 such that the opening central axis 132 is offset from the reservoir central axis 130 by an offset distance 134. In particular, the upper opening central axis 132 is offset from the reservoir central axis 130 in a direction opposite and away from the reservoir's handle 102 (i.e., in the −X-direction as depicted in FIG. 5). In other words, the upper opening central axis 132 is positioned radially outward from the reservoir central axis 130 in a direction that extends away from the handle 102.

In the illustrated embodiment, the reservoir central axis 130 and the upper opening central axis 132 are parallel to one another. However, as the upper opening central axis 132 is offset from the reservoir central axis 130, the upper opening 104 is not concentric with the outer perimeter 105 of the reservoir 100. In the illustrated embodiment, the offset distance 134 is equivalent to approximately 20% of the radius of the reservoir 100 (i.e., the distance from the reservoir central axis 130 to the outer perimeter). However, according to various other embodiments, the relationship between the relative size and position of the reservoir 100 and its upper opening 104 may be such that the upper opening central axis 132 is offset from the reservoir central axis 130 by between 15% and 80% of the radius of the reservoir 100.

Figure 6:
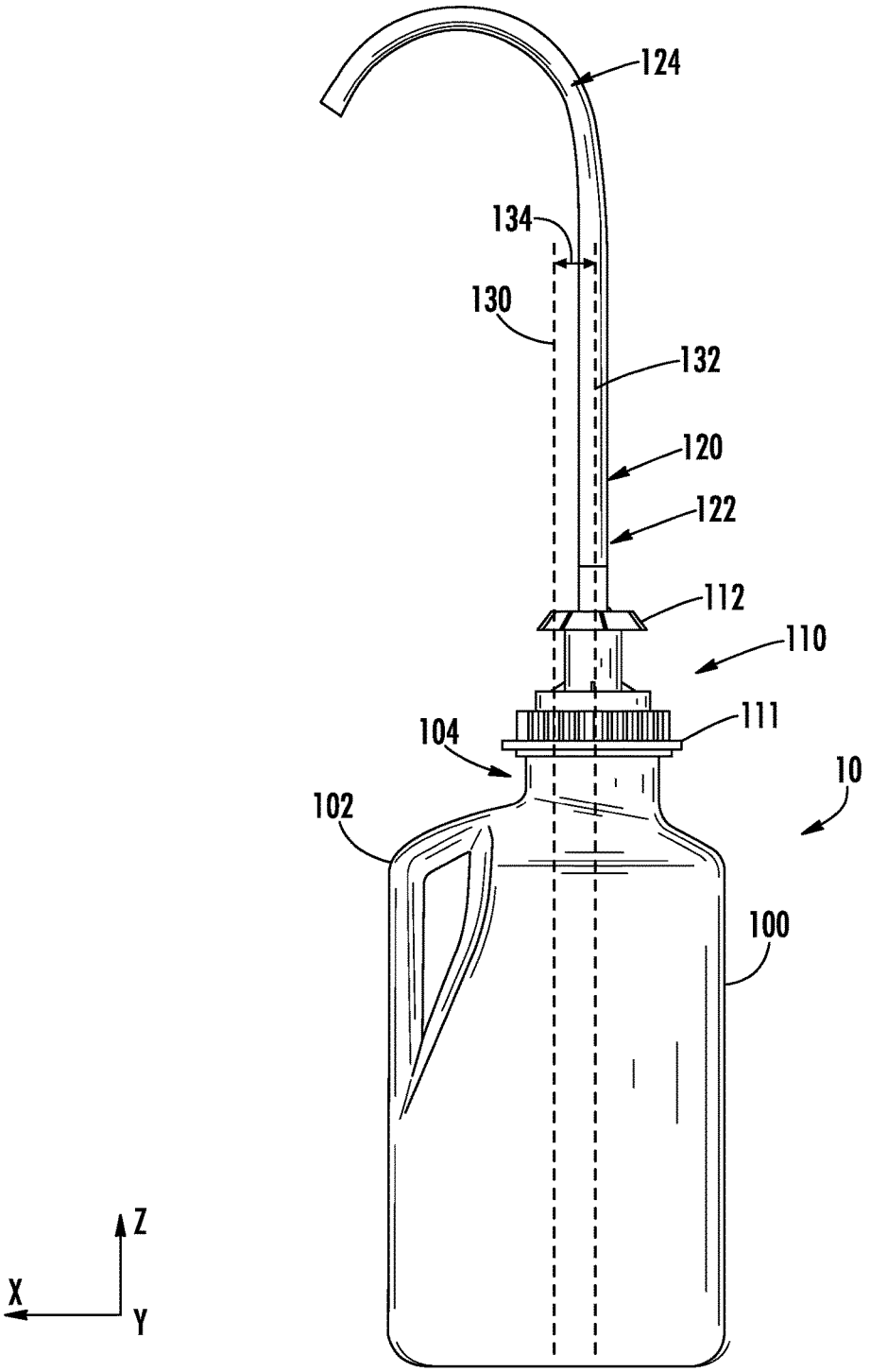
FIG. 6 shows a side view of the refill unit of FIG. 3 according to one embodiment.
Figure 7:
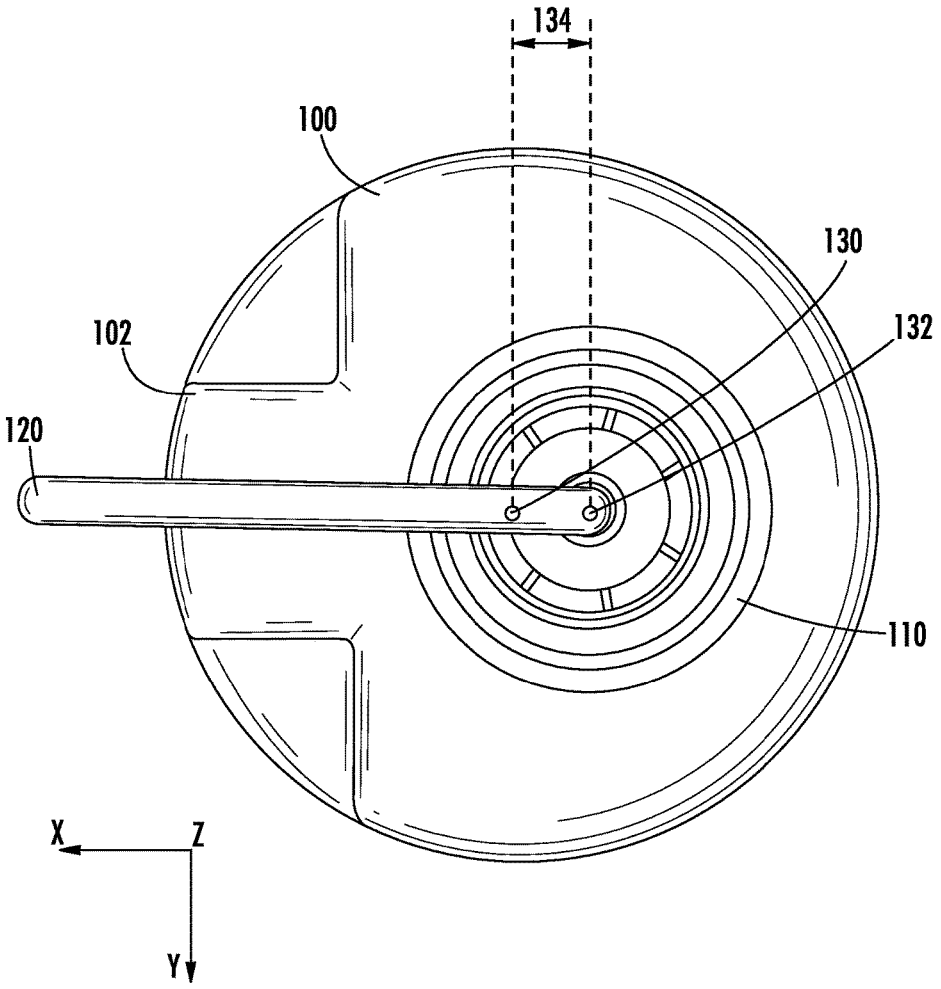
FIG. 7 shows an overhead view of the refill unit of FIG. 3 according to one embodiment.

FIGS. 6 and 7 show, respectively, a side view and an overhead view of the refill unit 10. As shown in FIGS. 6 and 7, the pump assembly 110 and the dispensing tube 120 are aligned with the upper opening central axis 132. As can be appreciated from the illustrations, the upper opening central axis 132 extends through the geometric center of the pump assembly 110 and the geometric center of the lower portion 122 of the dispensing tube 120. As a result, the pump assembly 110 and the dispensing tube 120 are generally offset from the reservoir's central axis 130 by the offset distance 134 in a direction opposite the handle 102. As explained in greater detail herein, offsetting the upper opening central axis 132 from the reservoir central axis 130 in a direction that extends away from the handle 102 improves the ease with which the refill unit 10 may be engaged with and removed from the drive housing 20.

Figure 8:
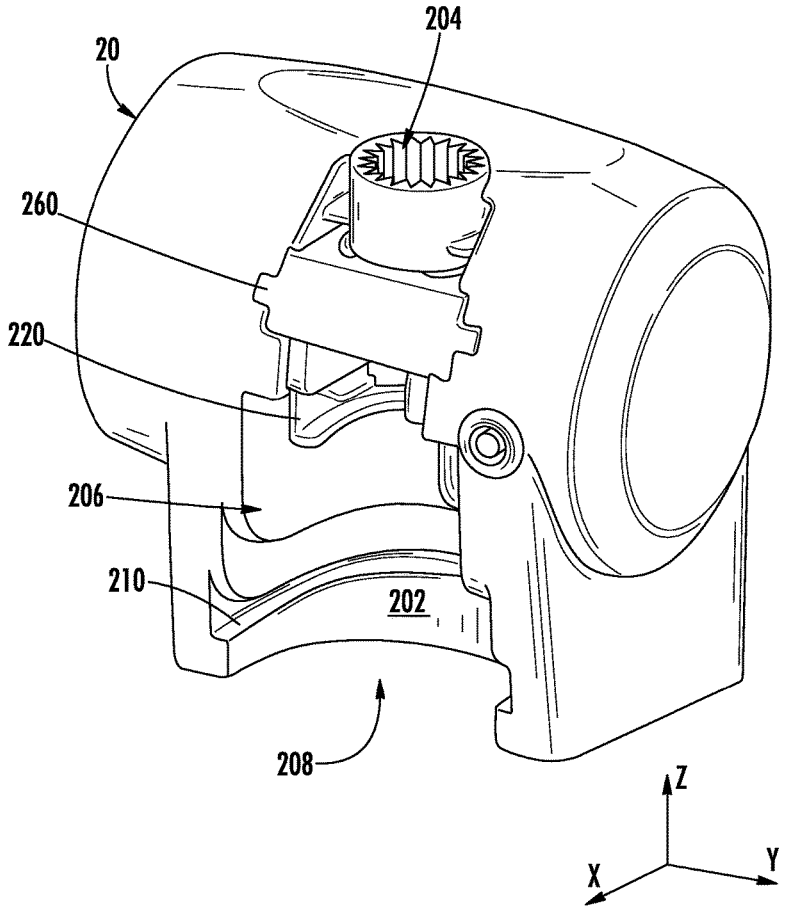
FIG. 8 shows a perspective view of a drive housing of the dispenser of FIG. 1 according to one embodiment.
Figure 9:
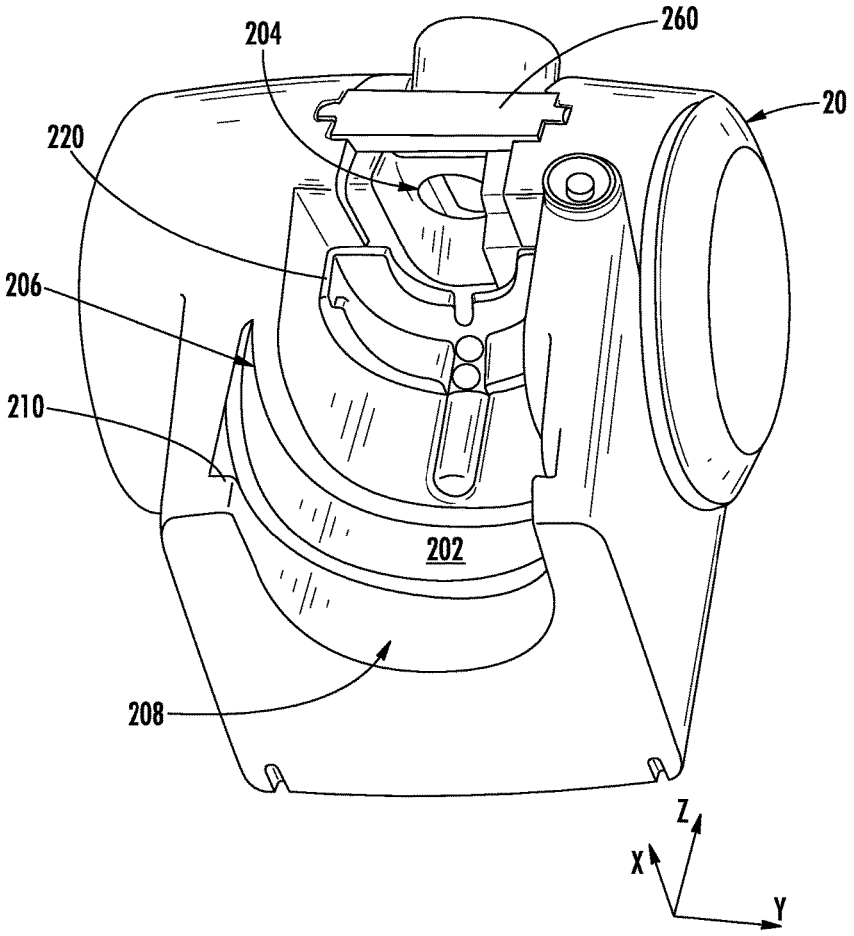
FIG. 9 shows a bottom perspective view of the drive housing of FIG. 8 according to one embodiment.

FIGS. 8 and 9 show, respectively, a perspective view and a bottom perspective view of the drive housing 20. In the illustrated embodiment, the drive housing 20 defines a cavity 202 shaped to receive the refill unit's pump assembly 110. The cavity is accessible through a cavity opening in the drive housing comprised of a front opening portion 206 and a bottom opening portion 208. As shown in FIGS. 8 and 9, the front opening portion 206 extends across the front face of the drive housing 20, while the bottom opening portion 208 extends across the bottom face of the housing 20. The front opening portion 206 and the bottom opening portion 208 are in communication with another and together define the cavity's opening 206/208.

The cavity 202 also includes an internal lip 210 that extends around an internal perimeter of the cavity 202 at a lower portion of the cavity 202. An upper portion of the cavity defines an aperture 204, which extends through an upper portion of the drive housing 20 and provides access to the cavity 202 from above the drive housing 20. The drive housing 20 further includes a drive member 220 configured for vertical movement with respect to the drive housing 20. As can be appreciated form FIGS. 8 and 9, the drive member 220 defines a recessed horizontal channel, which is configured for engagement with the pump assembly's actuator 112.

According to various embodiments, the drive member 220 is driven by a motor within the drive housing 20, which may be powered by the power unit 40. The power unit 40 may include a power source, such as a battery or the like, that provides power to drive the drive member 220 upward and downward in the vertical direction. According to various embodiments, the power unit 40 can be mounted below the countertop 5 separately from the drive housing 20 or attached to the drive housing 20. Additionally, the drive housing 20 is configured to communicate with the spout's sensor 302 and to vertically actuate the drive member 220 in response to a signal received from the spout's sensor 302 (e.g., using power from the power unit 40).

Referring back to FIGS. 1 and 2, the drive housing 20 is secured beneath the countertop 5 by a mounting shaft 304. In the illustrated embodiment, the mounting shaft 304 is a generally cylindrical member defining a passageway therethrough. An upper portion of the mounting shaft 304 is attached to the bottom the spout 30 (either permanently or releaseably) such that the mounting shaft's passageway is in communication with the passageway through the spout 30. The mounting shaft 304 is vertically oriented and extends downwardly through a counter aperture 7. As a result, a lower portion of the mounting shaft 304 is positioned below the countertop 5.

The drive housing 20 is secured to the mounting shaft 304 by positioning the lower portion of the mounting shaft 304 within the drive housing's aperture 204. A clip 260 is then used to secure the drive housing 20 to the mounting shaft 304. In this way, the drive housing 20 is suspended below the countertop 5 and beneath the spout 30. As the mounting shaft 304 extends through the drive housing's aperture 204, the mounting shaft's central passageway is in communication with the drive housing's cavity 202 (and thereby the cavity 202 is in communication with the spout's passageway).

The refill unit 10 can be installed into the drive housing 20 in a generally horizontal direction. In particular, the cavity opening 206/208 to the drive housing's cavity 202 is dimensioned to receive the pump assembly 110 in a horizontal direction. To insert the refill unit 10 into the drive housing 20, the refill unit's dispensing tube 120 can first be inserted through the drive housing's aperture 204 and into the passageway of the mounting shaft 304. The refill unit 10 can then be engaged with the drive housing 20 by moving the pump assembly 110 laterally through the cavity's front opening portion 206 and into the cavity 202. When the pump assembly 110 is fully inserted into the cavity 202, the lower portion of the pump assembly 110 will extend downwardly through the cavity's bottom opening portion 208, with the reservoir 100 suspended below the drive housing 20.

In addition, when the pump assembly 110 is fully inserted into the cavity 202, the pump assembly's perimeter flange 111 (see FIG. 6) will rest on the cavity's internal lip 210. This supports the refill unit 10 and secures the refill unit 10 within the drive housing 20. Furthermore, as the refill unit 10 is engaged with the drive housing 20, the refill unit's dispensing tube 120 will be guided upwardly through the mounting shaft 304 and into the spout 30, such that the distal end of the dispensing tube 120 is proximate the distal end of the spout 30. The pump assembly's actuator 112 will also be engaged within the channel of the drive member 220.

To accomplish the engagement of the refill unit 10 with the drive housing 20, a user (e.g., a service technician assigned to maintain the dispenser) may grasp the handle 102 of the refill unit 10 and may move the refill unit 10 horizontally toward the drive housing 20. As the user guides the refill unit's pump assembly 110 into the drive housing in a generally horizontal direction, the user's reach will be effectively extended by the offset of the pump assembly 110 from the reservoir's central reservoir axis 130. As described herein, the refill unit's dispensing tube 120 and the pump assembly 110 are aligned with the upper opening central axis 132 (FIG. 6), which is offset from the reservoir central axis 130 (FIG. 6) in a direction that extends away from the handle 102. As a result, when the user reaches underneath the countertop 5 in engage the refill unit 10 with the drive housing 20, it is not necessary for the user to reach all the way to the position of the drive housing 20. Rather, the pump assembly 110 will reach the drive housing 20 and engage the drive housing's cavity 202 before the user has to reach the drive housing 20 due the offset of the pump assembly and dispensing tube 120 from the reservoir's handle 102. In effect, this reduces the horizontal distance that the user must reach under the countertop 5 (e.g., from a distal edge of the countertop 5) to install the refill unit 10. In addition, because the refill unit 10 does not have to be inserted directly upwardly, the vertical distance beneath the countertop 5 the refill unit 10 must be positioned in order for engagement is also reduced. By reducing the horizontal and vertical distance the user must reach to install the refill unit 10, the ergonomic burden on the user is reduced along with the time required to replace the refill unit (thereby reducing operating costs).

Once the refill unit 10 is fully engaged with the drive housing 20, the dispenser 1 is ready for operation. As noted above, the drive housing 20 is configured to vertically actuate its drive member 220 in response to a signal received from the spout's sensor 302. Accordingly, when the spout sensor 302 detects the presence of a user's hand, the sensor 302 transmits a signal to the drive housing 20 that actuates the drive member 220 downwardly. This movement causes the pump assembly's actuator 112 to also move downwardly, thereby causing a dose of foam soap to be pumped out of the refill unit 10 and through the spout 30. The drive member 220 then returns to its upper position by moving upwardly, which in turn moves the actuator 112 upwardly causing a new dose of liquid soap to be drawn out of the refill unit's reservoir 100 and into the pump assembly 110. When the reservoir 100 runs out of liquid soap, the refill unit 10 can be removed in a manner opposite from the steps outlined above for engaging the refill unit 10 and can be replaced with a new refill unit 10. When the refill unit 10 is initially installed to the drive housing 20, an initial downward movement of the drive member 220 moves the actuator 112 downwardly and may cause the pump assembly's perimeter flange 111 to engage the drive housing 20. In this way, a user installing the refill unit 10 may connect the pump assembly 110 of the refill unit 10 to the drive housing 20 without significant manipulation or alignment.

As will be appreciated from the description here, various modifications to the dispenser 1 can be made within the scope the present invention. As one example, the reservoir 100 may be provided in other shapes (e.g., with a square cross-sectional profile). Similarly, the drive housing 20 may make use of other engagement features for securing the refill unit 10 upon its insertion into the drive housing's cavity. In addition, various other embodiments of the dispenser 1 may be adapted for dispensing other skincare products, such as unfoamed liquid soap, hand-sanitizing gel, or the like. As used herein, the term "fluid" is used to substances with no fixed shape and that yield easily to external pressure, including—but not limited to—liquids, gels, foams, and the like.

Many other modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A skincare dispenser configured for being mounted in a counter, the dispenser comprising:

a refill unit comprising:

a reservoir configured for holding a volume of skincare fluid and defining a reservoir central axis, wherein the reservoir includes a handle positioned on an outer perimeter of the reservoir and an upper opening defining an upper opening central axis that is offset from the reservoir central axis in a direction opposite the location of the handle relative to the reservoir central axis;

a pump assembly configured for drawing skincare fluid out of the reservoir and mounted on the reservoir's upper opening in alignment with the upper opening central axis, wherein the pump assembly defines an outwardly extending flange; and a dispensing tube extending upwardly from the pump assembly and configured for delivering skincare fluid pumped from the reservoir;

a drive housing configured for being mounted beneath the counter and defining a cavity shaped to receive the refill unit's pump assembly, wherein the cavity defines an internal lip configured to engage the pump assembly's outwardly extending flange when the pump assembly is disposed within the cavity in order to secure the refill unit to the drive housing, and wherein the cavity defines a cavity opening configured to accommodate insertion of the pump assembly into the cavity in a substantially horizontal direction; and a spout configured for extending upwardly from an upper surface of the counter, wherein the spout defines a central passageway configured for receiving the dispensing tube when the refill unit is secured to the drive housing.

2. The dispenser of claim 1, wherein a lower portion of the dispensing tube is secured to an upper portion of the pump assembly and is aligned with the upper opening central axis.

3. The dispenser of claim 1, wherein the reservoir comprises a bottle having a substantially circular cross-section.

4. The dispenser of claim 3, wherein the upper opening central axis is offset from the reservoir central axis by a distance that is between approximately 15% and 80% of the radius of the bottle.

5. The dispenser of claim 3, wherein the upper opening central axis is offset from the reservoir central axis by a distance that is approximately 20% of the radius of the bottle.

6. The dispenser of claim 1, wherein the refill unit's handle is circumscribed within the outer perimeter of the reservoir and defined by one or more indentations extending into the outer perimeter of the reservoir.

7. The dispenser of claim 1, wherein the pump assembly's outwardly extending flange comprises a perimeter flange that extends around and radially outward from the pump assembly.

8. The dispenser of claim 7, wherein the drive housing's internal lip extends inwardly around the interior of drive housing's cavity, and wherein the pump assembly's perimeter flange is configured for resting on top of the internal lip when the refill unit is secured to the drive housing.

9. The dispenser of claim 1, wherein the pump assembly includes an actuator that moves in a vertical direction.

10. The dispenser of claim 9, wherein the drive housing comprises a motor-driven drive member configured for engaging the pump assembly's actuator when the refill unit is secured to the drive housing.

11. The dispenser of claim 10, wherein the dispensing tube is configured to remain stationary when the actuator is actuated by the motor-driven drive member.

12. The dispenser of claim 10, wherein the spout includes a touchless sensor configured to actuate the motor-driven drive member in response to detecting the presence of a user's hand.

* * * * *